US005599485A

United States Patent [19]

Obermayer

[11] Patent Number: 5,599,485

[45] Date of Patent: Feb. 4, 1997

[54] PORTABLE HUMIDIFIER ASSEMBLY

[76] Inventor: Lothar C. Obermayer, 30 Mercer Dr., Brampton, Ontario, Canada, L6X 1B4

[21] Appl. No.: 574,224

[22] Filed: Dec. 18, 1995

[51] Int. Cl.[6] ..... B01F 3/04

[52] U.S. Cl. ..... 261/107; 454/291; 454/328; 454/337

[58] Field of Search ..... 261/30, 107; 454/291, 454/328, 337; 237/78 R

[56] References Cited

U.S. PATENT DOCUMENTS

| | | | |
|---|---|---|---|
| 447,942 | 3/1891 | Collins | 454/328 |
| 1,319,763 | 10/1919 | Drew | 454/328 |
| 1,927,733 | 9/1933 | Barton | 454/328 |
| 2,083,905 | 6/1937 | Grab | 237/78 R |
| 3,689,037 | 9/1972 | Payne | 237/78 R |
| 4,225,539 | 9/1980 | Grants | 261/107 |
| 4,289,508 | 9/1981 | Robert | 261/107 |
| 5,240,653 | 8/1993 | Ramkissoon | 261/107 |
| 5,403,233 | 4/1995 | Daneshvar | 454/291 |

*Primary Examiner*—Tim R. Miles

[57] ABSTRACT

A portable humidifier assembly adapted for use in association with a forced air heat vent, the apparatus comprising: an inner frame comprising a rear crossbar, a front crossbar and a plurality of semicircular ribs affixed therebetween, the front crossbar of the inner frame including a coupling device, an outer frame including a rear crossbar, a front crossbar and a plurality of semicircular ribs affixed therebetween, the rear crossbar of the outer frame being hingedly coupled to the rear crossbar of the inner frame, the front crossbar of the outer frame including a coupling device; and a sponge adapted to retain water, in an operative orientation the sponge being soaked with water and placed between the ribs of the inner and outer frames, the sponge being locked in placed by hingedly closing the outer frame upon the inner frame and coupling the front cross bars of the respective frames together.

5 Claims, 3 Drawing Sheets

PORTABLE HUMIDIFIER ASSEMBLY

BACKGROUND OF THE INVENTION

1. Field of the Invention

The present invention relates to a portable humidifier assembly and more particularly pertains to coupling the apparatus to a forced air heat vent to effect humidification of the proximate area.

2. Description of the Prior Art

The use of humidifier devices is known in the prior art. More specifically, humidifier devices heretofore devised and utilized for the purpose of humidifying air surrounding the devices are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,211,891 to Anoszko an evaporative pad frame.

U.S. Pat. No. 5,143,460 to Wang discloses a portable humidifier.

U.S. Pat. No. Des. 349,334 to O'Grady discloses an evaporative humidifier.

U.S. Pat. No. 5,061,405 to Stanek discloses a constant humidity evaporative wicking filter humidifier.

U.S. Pat. No. 5,273,689 to Hamasaki discloses a water-evaporation conduit for a humidifier.

Lastly, U.S. Pat. No. 4,225,542 to Wall discloses an evaporative humidifier.

In this respect, the portable humidifier assembly according to the present invention substantially departs from the conventional concepts and designs of the prior art, and in doing so provides an apparatus primarily developed for the purpose of coupling the apparatus to a forced air heat vent to effect humidification of the proximate area.

Therefore, it can be appreciated that there exists a continuing need for a new and improved portable humidifier assembly which can be used for coupling the apparatus to a forced air heat vent to effect humidification of the proximate area. In this regard, the present invention substantially fulfills this need.

SUMMARY OF THE INVENTION

In view of the foregoing disadvantages inherent in the known types of humidifier devices now present in the prior art, the present invention provides an improved portable humidifier assembly. As such, the general purpose of the present invention, which will be described subsequently in greater detail, is to provide a new and improved portable humidifier assembly and method which has all the advantages of the prior art and none of the disadvantages.

To attain this, the present invention essentially comprises a new and improved portable humidifier assembly adapted for use in association with a forced air heat vent, the apparatus comprising, in combination: an inner frame comprising a rear crossbar, a front crossbar, and seven semicircular shaped ribs affixed between the crossbars, the rear and front crossbars each including two ends, each end having one of the seven ribs coupled thereto, the rear edge including two noncontiguous long hinges extending therefrom, each hinge having an axial aperture extending therethrough, the long hinges being positioned a short distance from each end of the rear crossbar and separated from each other by a short distance, the front crossbar of the inner frame including an outwardly extending L-shaped latch member formed contiguously therewith, the latch member including a long segment and a short segment, the short segment having a free end including a semicircular protuberance; an outer frame including a rear crossbar and a front crossbar, each crossbar having two ends and a center point, each end and center point of the rear and front crossbars being coupled together by semicircular shaped ribs, the front crossbar including a recessed groove extending therealong, the rear crossbar having an outer surface including a short hinge extending from each end and center point thereof, each short hinge having an axial aperture extending therethrough, the outer frame being coupled to the inner frame by aligning the apertures of the long and short hinges and positioning a cylindrical pin through the aligned apertures thereby rotatably coupling the frames to each other; and a scented sponge formed in a generally rectangular configuration and including a scenting medium and an antibacterial agent, the sponge being colored and adapted to retain water therein, in an operative orientation the sponge being soaked with water and placed between the ribs of the inner and outer frames, the sponge being locked in placed by hingedly closing the outer frame upon the inner frame so that the protuberance of the latched member becomes locked within the recessed groove of the front bar of the outer frame, in an operative orientation the apparatus being coupled over a forced air heat vent whereby heated air passing through the scented sponge causes evaporation of water thereby humidifying the surrounding air, the passage of heated air through the scented sponge also causing the surrounding air to become scented.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable humidifier assembly which has all of the advantages of the prior art humidifier devices and none of the disadvantages.

It is another object of the present invention to provide a new and improved portable humidifier assembly which may be easily and efficiently manufactured and marketed.

It is further object of the present invention to provide a new and improved portable humidifier assembly which is of durable and reliable constructions.

An even further object of the present invention is to provide a new and improved portable humidifier assembly which is susceptible of a low cost of manufacture with regard to both materials and labor, and which accordingly is then susceptible of low prices of sale to the consuming public, thereby making such portable humidifier assembly economically available to the buying public.

Still yet another object of the present invention is to provide a new and improved portable humidifier assembly which provides in the apparatuses and methods of the prior art some of the advantages thereof, while simultaneously overcoming some of the disadvantages normally associated therewith.

Still another object of the present invention is to couple the apparatus to a forced air heat vent to effect humidification of the proximate area.

Lastly, it is an object of the present invention to provide a new and improved portable humidifier assembly adapted for use in association with a forced air heat vent, the apparatus comprising: an inner frame comprising a rear crossbar, a front crossbar and a plurality of semicircular ribs affixed therebetween, the front crossbar of the inner frame including a coupling device, an outer frame including a rear crossbar, a front crossbar and a plurality of semicircular ribs affixed therebetween, the rear crossbar of the outer frame being hingedly coupled to the rear crossbar of the inner frame, the front crossbar of the outer frame including a coupling device; and a sponge adapted to retain water, in an operative orientation the sponge being soaked with water and placed between the ribs of the inner and outer frames, the sponge being locked in placed by hingedly closing the outer frame upon the inner frame and coupling the front cross bars of the respective frames together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
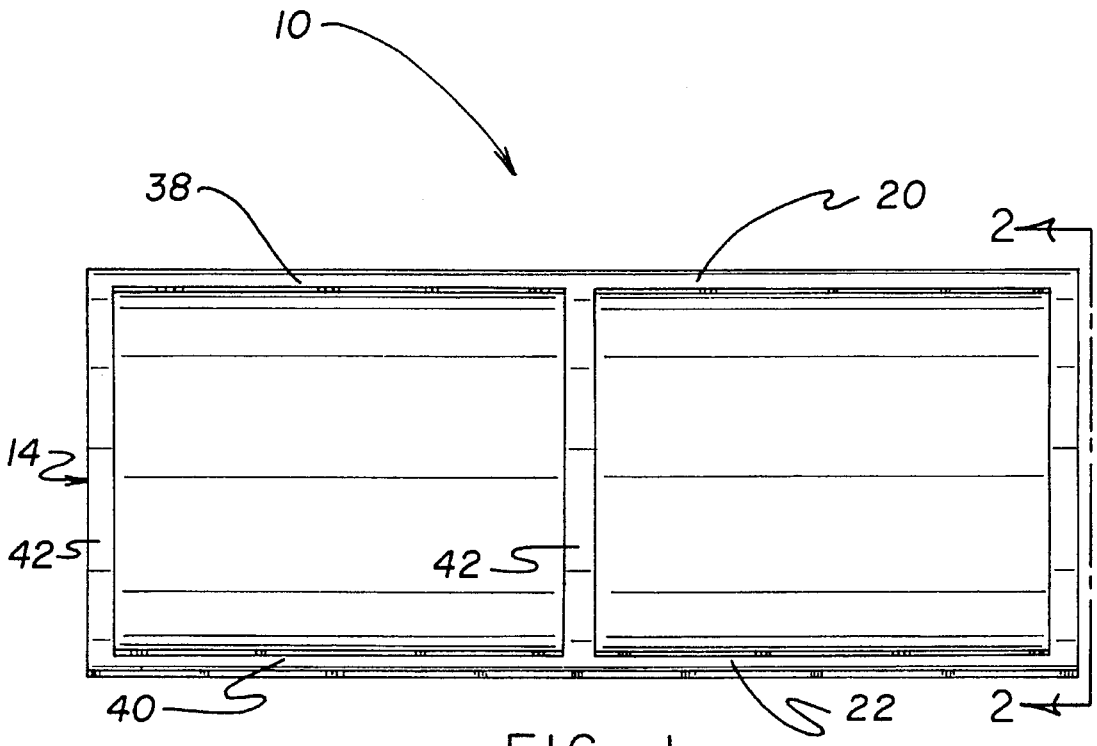
FIG. 1 is a perspective view of the preferred embodiment of the portable humidifier assembly constructed in accordance with the principles of the present invention.

With reference now to the drawings, and in particular to FIG. 1 thereof, the preferred embodiment of the new and improved portable humidifier assembly embodying the principles and concepts of the present invention and generally designated by the reference numeral 10 will be described.

The present invention, the portable humidifier assembly 10 is comprised of a plurality of components. Such components in their broadest context include an inner frame 12, an outer frame 14 and a sponge 16. Such components are individually configured and correlated with respect to each other so as to attain the desired objective.

Figure 2:
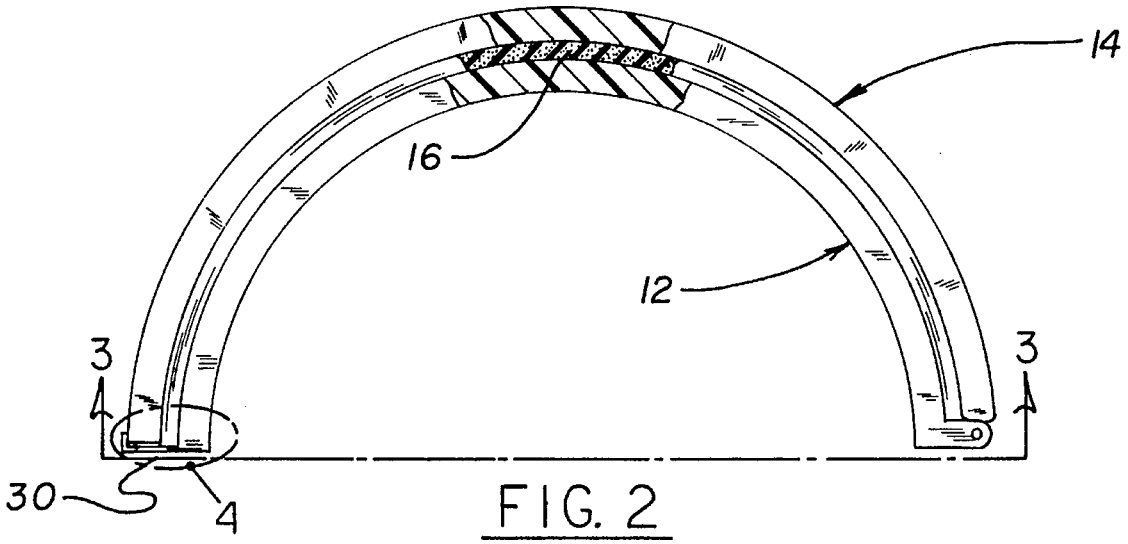
FIG. 2 is a side perspective view of the apparatus taken along section line 2—2 of FIG. 1.

The portable humidifier assembly is adapted for use in association with a forced air heat vent. In most situations the heat vent is formed in a generally rectangular configuration with a plurality of horizontal bars. Some heating devices have a curved heat vent and some have a linear heat vent. The arced configuration of the present invention permits coupling to both curved and linear heat vents. Note FIG. 2.

Figure 3:
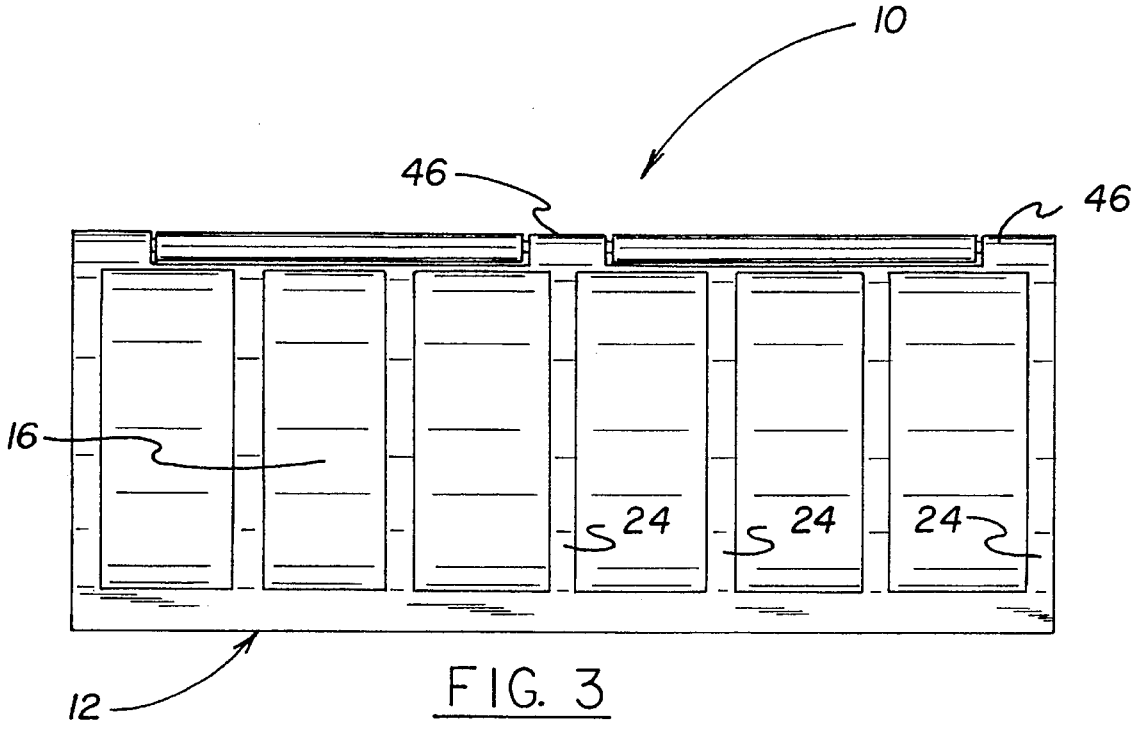
FIG. 3 is a bottom perspective view of the apparatus taken along section line 3—3 of FIG. 2.
Figure 5:
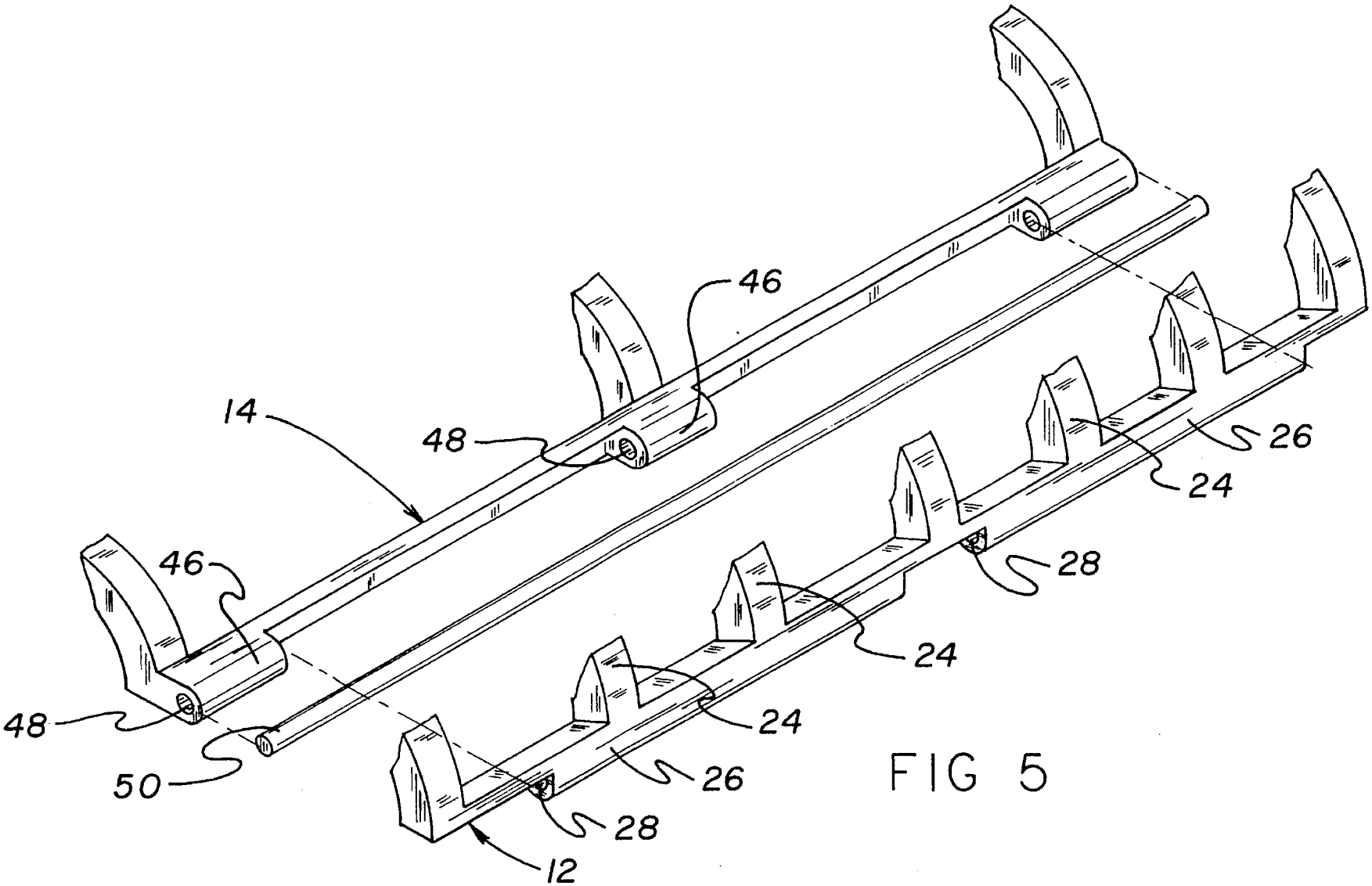
FIG. 5 is a perspective view of the rear cross bars and hinges of the apparatus.

More specifically, the inner frame 12 comprises a rear crossbar 20, a front crossbar 22, and seven semicircular shaped ribs 24 affixed between the crossbars. The seven ribs each have four sides and provide strength and stability to the apparatus. The inner and outer frames are fabricated of heat resistant plastic to withstand the forced air which is expelled by a heater unit during normal operation. The rear and front crossbars each include two ends. Each end has one of the seven ribs coupled to it. The rear edge includes two non-contiguous long hinges 26 extending from it. Each hinge has an axial aperture 28 extending through it. The long hinges are positioned a short distance from each end of the rear crossbar and separated from each other by a short distance. In the fully assembled orientation the short hinges of the outer frame are coupled between the long hinges of the inner frame. Note FIG. 3 and 5.

Figure 4:
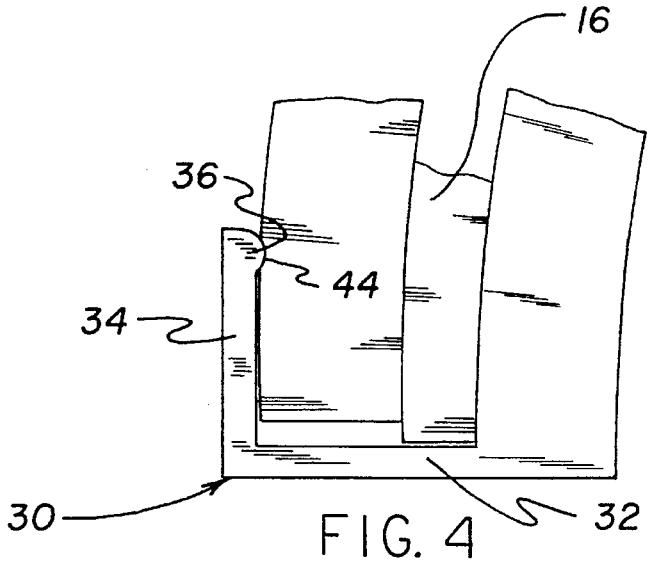
FIG. 4 is an isolated perspective view of the L-shaped latch member of the inner frame taken along section line 4 of FIG. 2.

The front crossbar 22 of the inner frame includes an outwardly extending L-shaped latch member 30 which is formed contiguously with the front crossbar. The latch member includes a long segment 32 and a short segment 34. The short segment is flexible and has a free end which includes a semicircular protuberance 36. In an operative orientation the protuberance is coupled within the groove of the outer cross bar to secure the inner and outer frames together in a closed orientation. Note FIGS. 2 and 4.

An outer frame 14 includes a rear crossbar 38 and a front crossbar 40. Each crossbar has two ends and a center point. Each end and center point of the rear and front crossbars are coupled together by semicircular shaped ribs 42. The three ribs of the outer frame each have four sides and provide strength and stability to the apparatus. The front crossbar includes a recessed groove 44 extending along it. In an operative orientation the protuberance is coupled within the groove of the outer cross bar to secure the inner and outer frames together in a closed orientation. Note FIGS. 1, 2 and 4.

The rear crossbar has an outer surface which includes a short hinge 46 extending from each end and its center point. Each short hinge has an axial aperture 48 extending through it. The outer frame is coupled to the inner frame by aligning the apertures of the long and short hinges and positioning a cylindrical pin 50 through the aligned apertures thereby rotatably coupling the frames to each other. The hinges permit pivotable opening of the frames at an angle of between about ninety and two hundred and seventy degrees. Note FIGS. 2, 4 and 5.

A scented sponge 16 is formed in a generally rectangular configuration. The sponge is fabricated of a colored elastomeric material which has the ability to retain water within it. The frames and sponge are manufactured in a plurality of colors to permit matching with the decor of the user. The sponge includes a scenting medium and an antibacterial agent. In an operative orientation the sponge is soaked with water to make it moist but not wet. The inner and outer frames are then pivotally separated. The user then places the moist sponge between the ribs of the frame, closes the outer frame upon the inner frame, and locks the protuberance 36 of the inner frame within the groove 44 of the outer frame. The sponge requires remoistening once or twice per day. Note FIGS. 2 and 4.

In an operative orientation the apparatus is coupled over a forced air heat vent whereby heated air passing through the scented sponge 16 causes evaporation of the water in the sponge thereby humidifying the surrounding air. The passage of heated air through the scented sponge 16 also serves to trap small dust particles and causes the air to become scented. The antibacterial agent disinfects the air passing through the sponge and prevents bacterial growth within the sponge. Note FIGS. 1–3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable humidifier assembly adapted for use in association with a forced air heat vent, the apparatus comprising, in combination:

an inner frame comprising a rear crossbar, a front crossbar, and seven semicircular shaped ribs affixed between the crossbars, the rear and front crossbars each including two ends, each end having one of the seven ribs coupled thereto, the rear edge including two noncontiguous long hinges extending therefrom, each hinge having an axial aperture extending therethrough, the long hinges being positioned a short distance from each end of the rear crossbar and separated from each other by a short distance, the front crossbar of the inner frame including an outwardly extending L-shaped latch member formed contiguously therewith, the latch member including a long segment and a short segment, the short segment having a free end including a semicircular protuberance;

an outer frame including a rear crossbar and a front crossbar, each crossbar having two ends and a center point, each end and center point of the rear and front crossbars being coupled together by semicircular shaped ribs, the front crossbar including a recessed groove extending therealong, the rear crossbar having an outer surface including a short hinge extending from each end and center point thereof, each short hinge having an axial aperture extending therethrough, the outer frame being coupled to the inner frame by aligning the apertures of the long and short hinges and positioning a cylindrical pin through the aligned apertures thereby rotatably coupling the frames to each other; and a scented sponge formed in a generally rectangular configuration and including a scenting medium and an antibacterial agent, the sponge being colored and adapted to retain water therein, in an operative orientation the sponge being soaked with water and placed between the ribs of the inner and outer frames, the sponge being locked in placed by hingedly closing the outer frame upon the inner frame so that the protuberance of the latched member becomes locked within the recessed groove of the front bar of the outer frame, in an operative orientation the apparatus being coupled over a forced air heat vent whereby heated air passing through the scented sponge causes evaporation of water thereby humidifying the surrounding air, the passage of heated air through the scented sponge also causing the surrounding air to become scented.

2. A portable humidifier assembly adapted for use in association with a forced air heat vent, the apparatus comprising:

an inner frame comprising a rear crossbar, a front crossbar and a plurality of semicircular ribs affixed therebetween, the front crossbar of the inner frame including a coupling device, an outer frame including a rear crossbar, a front crossbar and a plurality of semicircular ribs affixed therebetween, the rear crossbar of the outer frame being hingedly coupled to the rear crossbar of the inner frame, the front crossbar of the outer frame including a coupling device; and a sponge adapted to retain water, in an operative orientation the sponge being soaked with water and placed between the ribs of the inner and outer frames, the sponge being locked in placed by hingedly closing the outer frame upon the inner frame and coupling the front cross bars of the respective frames together.

3. The portable humidifier assembly as set forth in claim 2 wherein the coupling device on the front cross bar of the inner frame is an outwardly extending L-shaped latch member, the latch member includes a long segment and a short segment, the short segment has a free end which includes a semicircular protuberance.

4. The portable humidifier assembly as set forth in claim 2 wherein the sponge includes a scenting medium and an antibacterial agent.

5. The portable humidifier assembly as set forth in claim 4 wherein the sponge is fabricated in a plurality of different colors.

* * * * *